United States Patent [19]

Conant et al.

[11] Patent Number: 4,678,028

[45] Date of Patent: Jul. 7, 1987

[54] PLASTIC LABORATORY CONDENSER

[75] Inventors: Louis A. Conant; Wilbur M. Bolton, both of Rochester; James E. Wilson, Livonia, all of N.Y.

[73] Assignee: Intertec Associates Inc., Rochester, N.Y.

[21] Appl. No.: 820,125

[22] Filed: Jan. 21, 1986

Related U.S. Application Data

[63] Continuation-in-part of Ser. No. 703,344, Feb. 20, 1985, abandoned.

[51] Int. Cl.[4] ..... F28B 1/02

[52] U.S. Cl. ..... 165/72; 165/75; 165/74; 165/110; 165/133; 165/164; 165/905

[58] Field of Search ..... 165/164, 905, 110, 111, 165/133, 72–75

[56] References Cited

U.S. PATENT DOCUMENTS

| | | | |
|---|---|---|---|
| 1,813,871 | 7/1931 | Ayers | 165/74 |
| 2,582,969 | 1/1952 | Dinsmore | 165/74 |
| 3,882,934 | 5/1975 | Knoos et al. | 165/164 |

FOREIGN PATENT DOCUMENTS

| | | | |
|---|---|---|---|
| 102633 | 4/1899 | Fed. Rep. of Germany | 165/73 |

*Primary Examiner*—Albert W. Davis, Jr.
*Attorney, Agent, or Firm*—Marjama & Pincelli

[57] ABSTRACT

An impact resistant compact condenser comprising a plastic shell having two side walls enclosing at least one heat transfer disc disposed between said side walls dividing the shell into at least one cooling cell and at least one vapor cell. Means are provided for retaining said disc in sealed abutment against said end walls of said side walls, each of said cells having an inlet port and an outlet port.

36 Claims, 5 Drawing Figures

PLASTIC LABORATORY CONDENSER

This is a continuation-in-part of application filed Feb. 20, 1985, Ser. No. 703,344 now abandoned.

FIELD OF INVENTION

This invention is directed to a compact plastic condenser, useful generally in laboratory, industrial, service, or domestic applications wherein glass condensers would usually be used.

BACKGROUND OF THE INVENTION

Glass condensers are used in virtually all chemical laboratories because of their excellent chemical resistance to most corrosives, and for their transparency, however glass is a highly brittle material subject to catastrophic failure by relatively low impacts, and thermal shock, particularly in thick sections. Glass is also very sensitive to scratches, nicks, and other defects which act as stress raisers resulting in failure at the slightest impact. A variety of plastic materials, particularly the fluoroplastics, are also highly resistant to most corrosives, even more so than borosilicate glass. Many are transparent or translucent, resistant to breakage, and are relatively economical to produce. However plastic materials have low thermal conductivity, about ¼ to 1/6th that of glass and therefore poorly suited for making condensers. Some industrial type heat exchangers, of the shell and tube type, utilize a large number of small bore TFE fluoroplastic tubes having a large surface area for heat transfer. Such exchangers are generally not adaptable for laboratory use.

It is therefore apparent that there has existed for a long time a need for a laboratory condenser that has good impact resistance, excellent chemical resistance, transparency or translucency, one that can function as good or better than glass, and one that is much safer to use.

SUMMARY OF INVENTION

This invention provides an impact resistant compact condenser having excellent chemical resistance, good heat transfer performance, and one that is much safer than glass to use, consisting of a plastic shell enclosing a heat transfer disc or discs dividing it into a water cooling cell or cells and a vapor cell or cells, with means for retaining said disc or discs in sealed abutment against cylindrical end walls of said plastic shell, said cells having inlet and outlet ports.

DETAILED DESCRIPTION OF THE INVENTION

Figure 1:
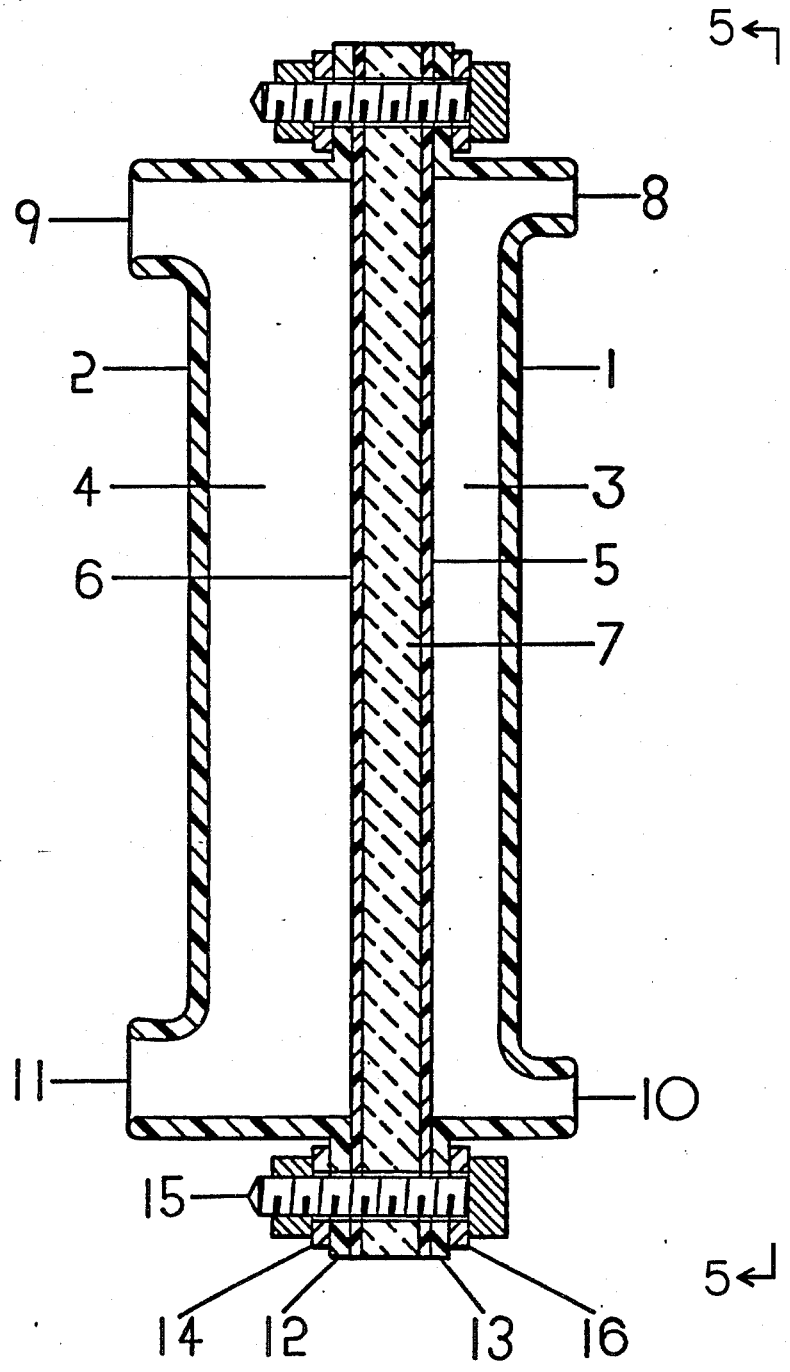
FIG. 1 is a cross sectional view of a condenser made in accordance with the present invention.
Figure 5:
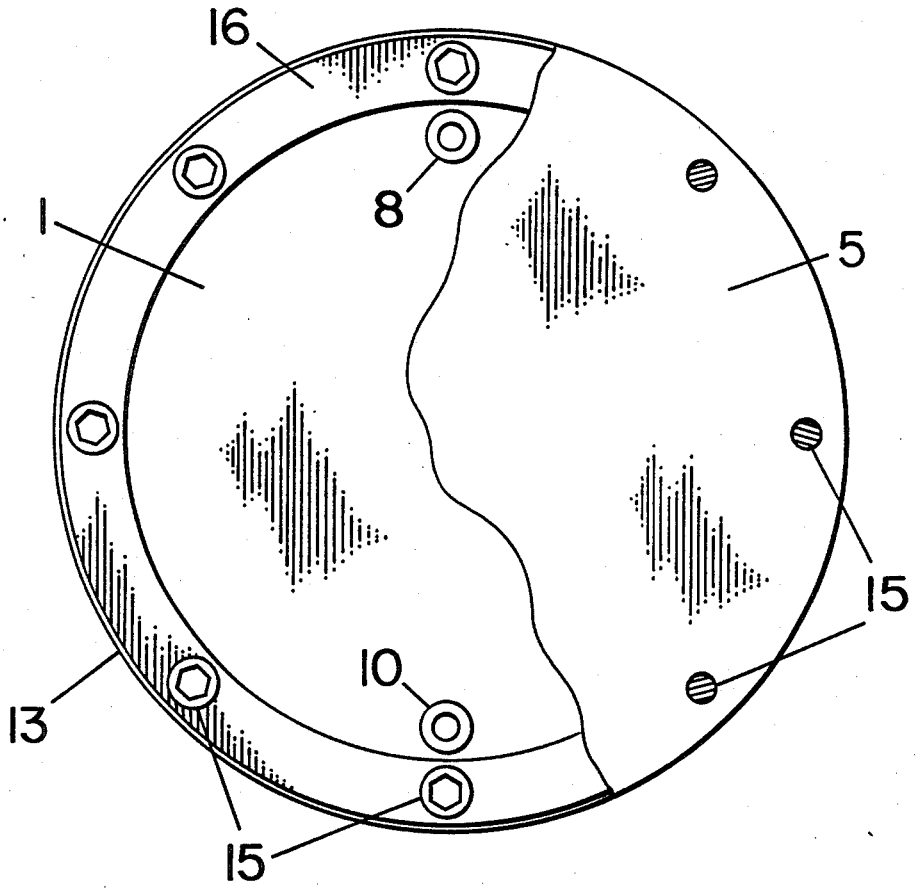
FIG. 5 is a side cross sectional view of the condenser taken along line 5—5 of FIG. 1.

Referring to FIGS. 1 and 5 there is illustrated a condenser made in accordance with one embodiment of the present invention. In the particular embodiment illustrated the condenser comprises plastic side walls 1, 2. A heat transfer disc 7 is disposed between side walls 1 and 2 so as to divide the condenser into a vapor cell 4 and a cooling cell 3. The shell wall 2 of vapor cell 4 is provided with a vapor inlet port 9 and condensate outlet port 11. The shell wall 1 of cooling cell 3 is provided with cooling inlet port 10 and outlet port 8. The periphery of shell walls 1, 2 are each provided with an annular flange 13, 12, respectively. The disc 7 is disposed between flanges 12 and 13 and is secured in position by fastening means 15. In the particular embodiment illustrated reinforcing rings 14 and 16 are disposed between fastening means 15 and flanges 12 and 13 respectively for improved durability. During use of the condenser of FIG. 1 vapor is allowed to come in through inlet port 9 and leave as a condensate through exit port 11 while cooling liquid, preferably water, is supplied at inlet port 10 and is exited at outlet port 8. The disc 7 has plastic film coatings 5, 6 disposed on the cooling cell and vapor cell sides so as to minimize corrosive effects of the vapor and cooling liquid.

Figure 2:
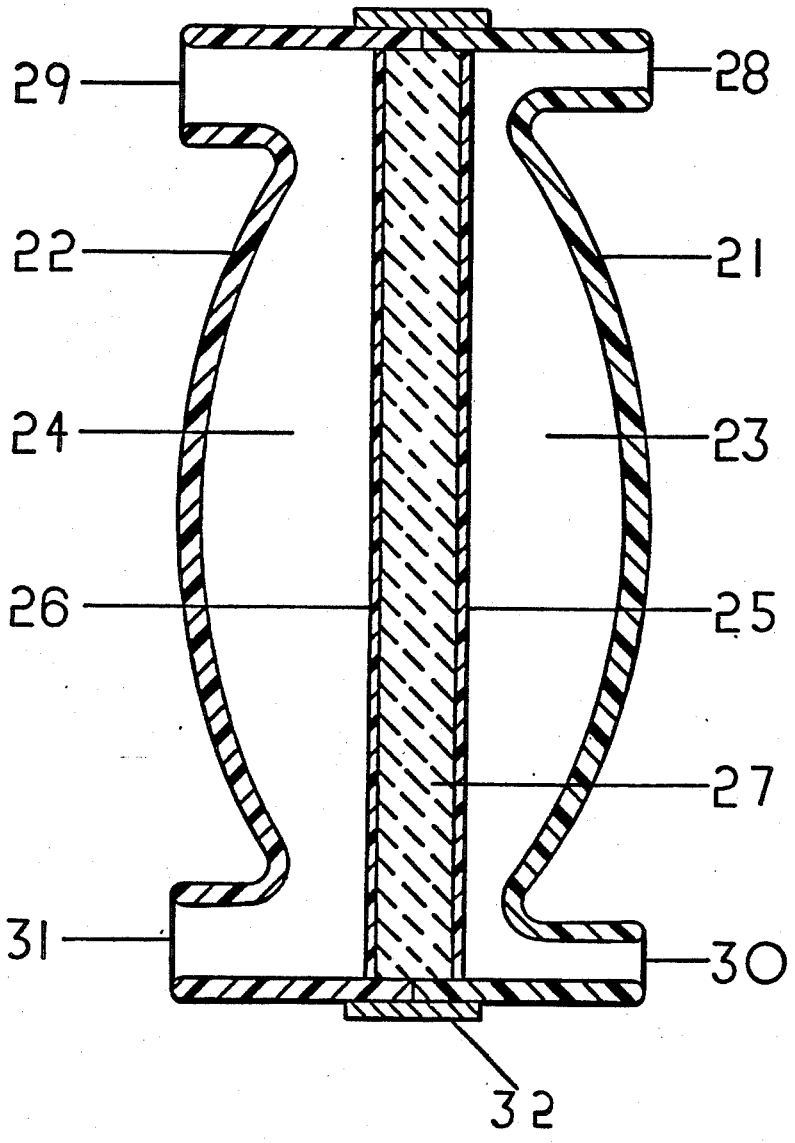
FIG. 2 is a cross sectional view of an alternate embodiment of a condenser made according to the present invention.

Referring to FIG. 2 there is illustrated an alternate embodiment of the present invention wherein a condenser is provided with plastic shell side walls 21 and 22. Disposed between the side walls 21 and 22 is heat transfer disc 27 which divides the condenser into a cooling cell 23 and vapor cell 24. Side wall 21 provided with liquid cooling inlet port 30 and outlet port 28. The side wall 22 provided with a vapor inlet port 29 and condensate outlet port 31. The heat transfer disc 27 is provided with a plastic film coating 25 on the cooling cell side of disc 27 and plastic film coating 26 on the vapor cell side. The side walls 21, 22, and heat transfer disc 27 are held together by a compression shrink ring 32 disposed around the periphery of the side walls. The side walls 21 and 22 have a substantially convex contour with repsect to the heat transfer disc.

Figure 3:
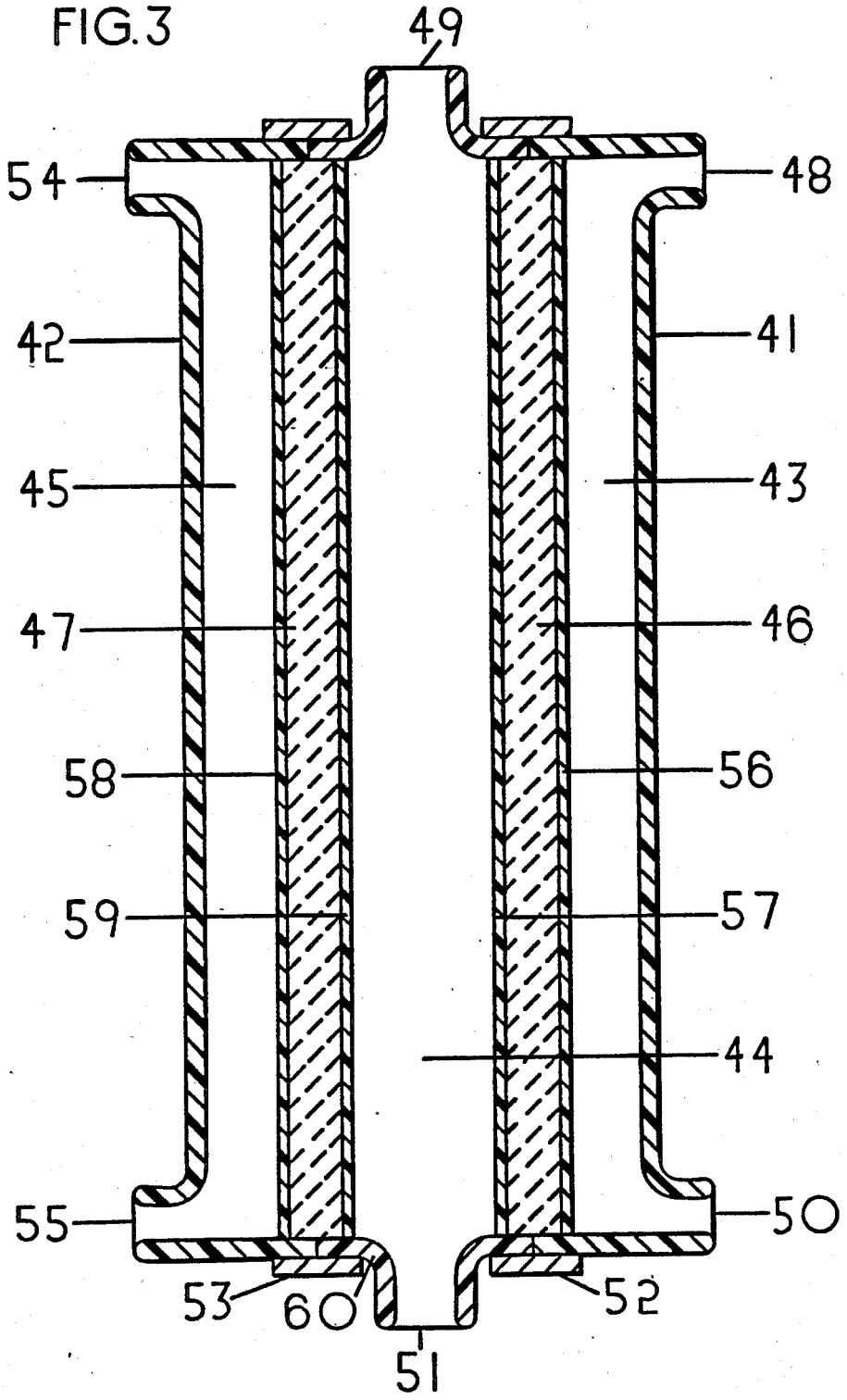
FIG. 3 is a cross sectional view of another embodiment of a condenser made in accordance with the present invention.

Referring to FIG. 3 there is illustrated yet another embodiment of the present invention wherein two heat transfer discs 46 and 47 are provided. The condenser is provided with exterior shell side walls 41, 42. A plastic circumferential ring 60 is disposed between side walls 41 and 42. The ring 60 and side walls 41, 42 are held together by compression shrink rings 52, 53. However, any desired means may be used for maintaining side walls 41, 42, and circumferential ring 60 together. Heat transfer discs 46, 47 are disposed within the condenser so as divide the condenser into cooling cells 43, 45, and a vapor cell 44 located between cooling cells 43, 45. The heat transfer discs 46, 47 are disposed at any convenient position so long as they are sufficiently spaced apart to provide room for entering and exiting of the cooling liquid, vapor and condensate. In the particular embodiment illustrated the heat transfer disc is positioned where circumferential ring 60 meets side walls 42 and 41. The vapor cell 44 is provided with an inlet port 49 and outlet port 51 by ring 60. The cooling cell 43 provided with an inlet port 50 and outlet port 48 in side wall 41 and cooling cell 45 is provided with an inlet port 55 and outlet port 54 by sidewall 42. Heat transfer disc 46 is provided with a plastic film 56 and 57 on its respective cooling and vapor cell sides. Heat transfer disc 47 is also provided with a plastic film 58 and 59 on its cooling and vapor cell sides respectively.

Figure 4:
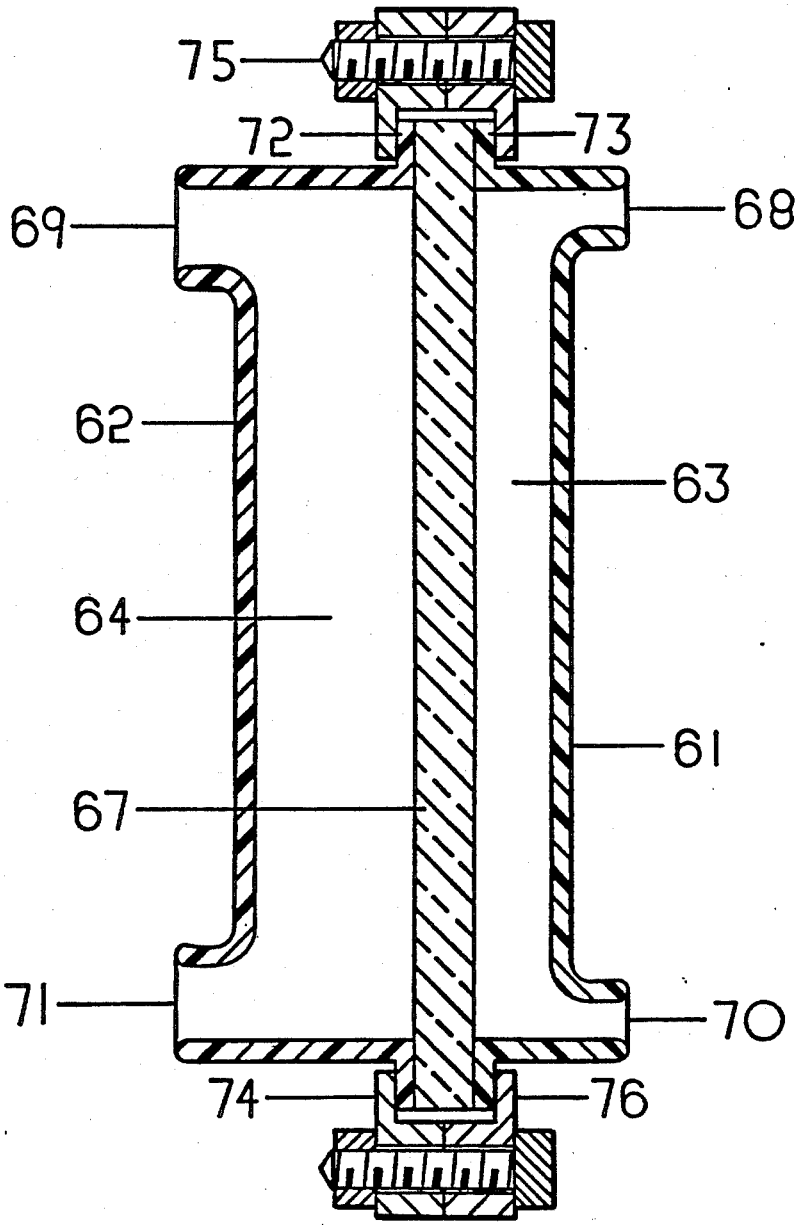
FIG. 4 is a cross sectional view of yet another embodiment of a condenser made in accordance with the present invention.

Referring to FIG. 4 there is illustrated yet another embodiment of the present invention. In this particular embodiment the condenser is provided with plastic shell side walls 61, 62 which are substantially identical to shell walls 1 and 2 of FIG. 1. A heat transfer disc 67 is provided which divides the condenser into cooling cell 63 and vapor cell 64. The side wall 61 is provided with a liquid cooling inlet port 70 and outlet port 68 and side wall 62 is provided with a vapor inlet port 69 and a condensate exit port 71. This condenser is very similar to that in FIG. 1 except that the means for holding the shell walls together is different and the heat transfer disc 67 does not have a protective film as illustrated in FIG. 1. The outer periphery of side walls 61 and 62 are each provided with a flange 73, 72 respectively wherein the heat transfer disc 77 is disposed there between. Clamping the flanges 72, 73 of side walls 61 and 62 together is a separable clamping rings 74, 76 held together by nut and bolt fastening means 75.

In the preferred embodiments of the invention condenser, the two plastic shell sides are molded, generally with inlet and outlet ports or openings. In three cell types, the center circumferential plastic ring with inlet and outlet ports or openings is also molded. Injection molding is the preferred manufacturing method, but other molding techniques well known to those in the field, such as compression molding, could also be used.

The condenser of the present invention is unique in that it combines a number of favorable characteristics and properties not found in any laboratory condenser, to the best of our knowledge. Thus it is compact, yet has a heat transfer performance as good and, in many embodiments superior, to conventional glass laboratory condensers. It is impact resistant and therefore much safer to use than all-glass condensers. The shell may be translucent or transparent for viewing the water cooling cell and vapor cell, where higher visibility is desired in the vapor cell, a glass heat transfer disc can be safely used since it is anti-shock mounted inside the plastic shell being fail-safe. The separable shell embodiments, heat exchange discs and shell sidewalls can be changed to different types. Various combinations of chemical resistivity and heat transfer for the heat transfer disc may be easily retained to suit the desired application, and yet be easily changed to accommodate different requirements. This is particularly useful for experimental work, or in pilot plant industrial areas. For example, where ultra high purity may be required as in biological or pharmaceutical work; or where different metallic discs can be evaluated for use in highly hostile environments by condensing vapors such as hydrofluoric acid, or where high rates are required without he highest purity, as in domestic water purification systems.

The geometry of the condenser is essentially disc shaped, as are the cells and the heat transfer wall (the heat transfer disc). The side walls of the disc are preferably substantially flat and substantially parallel to each other. The disc is also preferably positioned such that the sides are aligned substantially parallel to the shell walls as illustrated in FIG. 1. However, if desired the disc may have other cross-sectional shape may be used if desired, for example, the disc may have a corrugated cross-section configuration. The side walls of the disc are preferably smooth so as to minimize the collection of impurities that may collect on the surface and thereby reduce the efficiency of the device. The disc shape cells give a relatively high volume for a high water flow and very little pressure drop, to give an effective cooling, and the disc-shaped vapor cell holds a relatively large volume of vapor. For example a 6 in. disc condenser has a water cooling cell volume of 375 cc compared to a spiral Friedrich type glass condenser ($12\frac{1}{2}$ in. long$\times$2 in. O.D.) which has a volume of water cooling of 140 cc, which is about $\frac{1}{3}$ of disc type. The vapor volume capacity of the Friedrich glass condenser is 145 cc compared to 325 cc for the disc or less than $\frac{1}{2}$ of the disc condenser. The geometry of the condenser or disc, as shown in FIGS. 1 and 5, could also have been hexagonal, octagonal, square, rectangular, etc., with relatively narrow parallel cells, however the disc shape lends itself to ease of fabrication, production, and economy, and is the preferred geometry. For the purposes of this invention the term "disc" shall be considered any of the foregoing configurations including circular. The side wall of the disc on the vapor cell side is preferably spaced a distance from the shell so as to cause turbulent flow in the vapor cell. The side wall of the disc on the cooling cell side may be spaced from the shell a distance sufficient for proper heat transfer.

The heat transfer disc may be composites of graphitic material with plastic coating of polymers, previously mentioned, and given in the following examples. Metallic substrates are also suitable as composites with plastic coatings, or with one coating on vapor side of disc or in some embodiments with uncoated surfaces. Borosilicate glass or glass-ceramic discs without coatings are also embodiments, as are glassed steel or glass-ceramic coated steel. In some applications where visibility in vapor cells is required under highly corrosive conditions to glass such as hydrofluoric acid or alkali vapors, the glass disc is coated with a thin film of fluoroplastic on the vapor side of disc.

The protective film coating of a chemically resistant material on the disc should be thin for minimal resistance to heat transfer but of sufficient substance to be resistant to vapor or liquid penetration into the graphitic or metallic base disc. Glass or glass-ceramic coatings should also be thin for the same reasons, although they may be thicker than plastic films because of their higher thermal conductivity. While protective film coatings have been shown on both sides of the disc, in some embodiments such as with metal discs, only the vapor cell side need be coated although for most applications both surfaces of disc are coated. In either embodiments, such as with heat transfer discs made of borosilicate glass or borosilicate glass-ceraminc, coatings or films are generally not required, except where hydrofluoric acid, strong alkalies, and other materials corrosive to glass are used. The protective film coating on the vapor cell side is preferably made of a fluroplastic, and on the water side a fluoroplastic, polyolefin or other chemically resistant plastic.

Applicant built and tested various embodiments of the present invention. The description and results of such efforts are set forth in the following examples:

EXAMPLE 1

This laboratory condenser was built in accordance with FIG. 1 and was fabricated by machining out the bottoms of two PETFE (polyethylene tetrafluoroethylene) vessels, and welding $\frac{1}{2}$ in. wide PETFE flanges to each of the dish-shaped bottoms (about 6 in. diameter$\times$1 in. wide$\times\frac{1}{8}$ in. wall). The two dish-shaped flanged bottoms formed the two halves of the separable shell which enclosed the heat transfer disc, dividing it into two cells, a water cooling cell 3 about 6 in. dia. × ½ in. wide, and a vapor cell 4 of the same diameter and about ¾/ in. wide. The two halves of the separable shell, enclosing the disc, were securely fastened and sealed by means of stainless steel, type 316, nuts and bolts through aligned holes in the flanges, disc, and 1/16 in. thick stainless steel reinforcing rings. Polycarbonate reinforcing rings, or other high strength plastics or fiber reinforced plastic rings and plastic nuts and bolts, could have been used if an all plastic shell was desired. A polycarbonate, polysulfone, or other suitable transparent plastic could also have been used as the shell side of the cooling cell in place of the translucent PETFE. The PETFE plastic, or other fluoroplastic, is desirable for the vapor cell side of the shell because of its excellent chemical resistance and other physical and mechanical properties.

The heat transfer disc was machined from an extruded graphite cylinder having a bulk density of 1.7 g/cc., and a fine to medium grain size structure. The disc was laminated to a PFA (film about 0.005 in. thick) at a molding temperature of about 600° F., and a pressure of 200–300 psi for a time of 5 minutes. The polymer was forced into the pores of the graphite surface forming a strong bond, and being reduced to a 0.002 in. thick film coating. This laminated plastic formed the cooled condensing surface of the vapor cell. The opposite side of the graphite disc was laminated to a 0.003 in. PCTFE film at a temperature of about 415° F., and at a pressure of 250 psi for 5 minutes. The film was reduced to a surface thickness of about 0.0015 in. This PCTFE film formed the cooling surface side of the cell. This film has excellent resistance to water absorption as well as very good chemical resistance. Two openings diametrically opposite each other were made in the vapor cell: the inlet port 9 (top) and condensed vapor outlet port 11 (bottom). Two diametrically spaced openings were also made in the water cooling cell 3: the inlet 10 at the bottom, and outlet 8 at the top. In this example the vapor cell ports 9 and 11 were fitted with PTFE male hose (tube) connectors ⅜ in. I.D., and the water cooling ports fitted with compression type male hose connectors ⅜ in. O.D., although the ports could have been connected with any type of fitting for flexible or rigid tubing. In this respect, plastic materials are much better adapted to a variety of connecting methods than is glass.

In manufacturing this condenser the preferred method would be to mold the two halves with flanges, ports, and plastic reinforcing rings (if used). Assembly would therefore only require the insertion of the disc and fastening.

The condenser was evaluated with condensing steam, produced by a kettle vigorously boiling a measured amount of tap water (1 liter). The cooling water flow was at the rate of 120 l/hr. After 8 minutes from the start of condensation, 295.3 ml of condensed steam was collected, and 642 ml of water remained in the kettle, which represents a small loss of 63 ml. The condensate yield of 295.3 is equivalent to 2.22 l/hr. and with the heat transfer area of the condenser 0.196 sq. ft., the rate per hour per sq. ft. was 11.3 liter. This procedure was repeated 3 times with the same average results. In order to compare the performance of this condenser with that of a compact glass laboratory condenser, a Friedrich type condenser was used. This type, known for its efficient operation, has a helical inner tube with a heat transfer area of about 0.31 sq. ft. This tube closely fits within the outer glass shell or jacket. The space between is the vapor cell or shell to which a vapor tube inlet is sealed at 75° angle, and is tooled for a no. 3 rubber stopper. The bottom of the jacket ends in a drip tube about 3 in. long and serves as the outlet for the condensate. Cooling water circulates through the inside of the helix tube with glass inlet and outlet water tubes at the top end of the condenser. The overall length is 12¾ in. with an outer tube diameter of 2 in., whereas our plastic condenser is 6 in. in diameter by 2 in. wide.

The glass condenser was tested under the same conditions of steam inlet, and water cooling flow rate. Three runs were made with the following average values: steam condensed after 8 minutes—222 ml; water remaining in kettle—630 ml; which represents a loss of 148 ml. The condensate yield of 222 ml is equivalent to 1.66 l/hr., and with a heat transfer area of 0.31 sq. ft., is equivalent to 5.35 l/hr./ft.$^2$.

Comparing the plastic and glass condensers, it can be seen that the condensate yield is 11.3 l/hr./ft.$^2$ vs. 5.35 l/hr./ft$^2$ or 2.1 times greater than the glass condenser. The water loss, caused by non-condensing steam was 148 ml compared to only 63 for the plastic condenser, another indication of its higher efficiency.

The disc-shaped condenser was also compared to a well known industrial type of glass condenser consisting of spiral glass tubing coils, used for water cooling, inside a cylindrical glass shell where the vapor condenses outside the coils. The length of the condenser is 24 in. by about 2 in. in diameter with inlets and outlets at top and bottom. The company literature for February 1973 (Corning Co. Publication PE-260) gives representative heat transfer performance for their smallest condenser of this type (catalog reference HE 1.5) as: steam condensed 7 kg(l)/hr. at a cooling water flow rate of 700 kg(l)/hr., and an overall heat transfer area is given at approximately 2 sq. ft.

Comparing the above literature data with the measured values obtained by testing our plastic condenser, the results are as follows: for the HE 1.5 steam condensed 7 l/hr., divided by 2 ft.$^2$ of heat transfer area equals 3.5 l/hr./ft.$^2$, whereas our condenser at 11.3 is 3.23 times greater than the HE 1.5 glass condenser. The overall heat transfer coefficient of our plastic disc condenser is 164 compared to 54 for the HR 1.5 glass condenser, or 3 times greater.

EXAMPLE 2

This two cell laboratory condenser was built in accordance with the embodiment of FIG. 2 and was fabricated by machining out the bottoms of two vessels of the same size, one a PFA (perfluoroalkoxy) fluoroplastic, the other a polypropylene plastic. The two dish-shaped bottoms formed the two sides or halves of the condenser shell which enclosed the heat transfer disc which divided it into two cells: a water cooling cell about 6 in. in diameter by ½ in. wide by ⅛ in. wall, and a vapor cell of the same diameter by ¾ in. wide, by ¾ in. wall. The I.D. of the circumferential walls of the two sides were machined with a shallow recessed area to snugly fit the composite heat transfer disc. The O.D. of the walls were also machined with a shallow recessed area to seat the aluminum compression ring which was applied by shrink fitting. Stainless steel and fiber reinforced plastic rings have also been used. However a variety of stainless corrosion resistant metals and alloys including the stainless steels, nickel base alloys, cobalt base alloys, titanium, and plastic coated rings could also have been used. The aluminum compression ring was machined to an I.D. of 5.977 in., which was 0.023 in. less than the O.D. of the plastic shell at room temperature (6.000 in.). This difference (0.023 in.) represents the expansion of the aluminum band to a temperature up to about 350° F., well within the temperature the ring and plastic would reach in use. The 6061 alloy aluminum band was about ¾ in. wide by ⅛ in. thick.

The PFA plastic which formed the outer wall of the vapor cell is, along with PTFE, the most chemically resistant fluoroplastic, excelling glass in its resistance to hydrofluoric acid and alkalies, and for many ultra high purity applications. It was used in preference to PTFE because it can be injection molded to form the shell side, and thus lends itself to mass production whereas PTFE cannot be injection molded. PFA is also translucent. Polypropylene, which formed the outer wall of the water cooling cell, has good resistance to most chemicals and excellent resistance to water absorption. It is also translucent and a relatively low cost material that can be easily injection molded. Injection molding is the preferred method of molding the shell parts. The 6061 aluminum ring combines good corrosion resistance with good strength and is satisfactory for many applications. The heat transfer disc was machined from an extruded graphite cylinder having a bulk density of about 1.7 g/cc and a fine medium grain size structure. The disc about 5⅞ in. dia. by 0.5 in. thick was laminated to a 0.010 film of PFA at a molding temperature of about 600° F., at a pressure of 200–300 psi, for a time of 5 minutes. The PFA was forced into the pores of the graphite to a depth of as much as 0.010 in., forming a very strong bond, being reduced from a 10 mil starting film to a thickness of about 5 mils as the laminate surface thickness. This PFA coating formed the inner wall of the vapor cell upon which the vapor condensed. The selection of PFA is also based on its non or low wettability because of its low surface energy. Whereas wettable surfaces favor continuous film formation, such as water vapor on clean glass, a non-wetting surface such as PFA, and some other fluoroplastics like PTFE, FEP and others, promote drop-wise condensation. This increases thermal conductance as opposed to increased thermal resistance by a continuous film on the surface of the condensing surface. The opposite side of the disc was laminated with a 0.005 in. (5 mil) thick film of PCTFE (polychlorotrifluoroethylene) at a temperature of about 415° F. and a pressure of about 200–300 psi for a time of 5 minutes, being reduced to about 2 mils. This laminate surface formed the inner wall of the water cooling cell. Two openings diametrically opposite each other were made in the vapor cell: the inlet top and condensed vapor outlet (bottom). Two openings were also made in the water cooling cell: the inlet at the bottom and outlet at the top. In this example the vapor cell ports were, as in example 1, fitted with PTFE male hose (tube) connectors ⅜ in. I.D., and water cooling ports fitted with compression type male hose connectors ⅜ in. O.D., although the ports could have been connected with any type of fitting for flexible or rigid tubing.

In manufacturing this condenser the preferred method would be to mold, particularly by injection molding, the two halves with ports.

The condenser was evaluated with condensing steam as described in example 1, with the following results: plastic condenser condensate yield was 7.4 l/hr./sq. ft. vs. Friedrich glass condenser with 5.35 l/hr./sq. ft. or 1.4 times higher than the glass condenser. The overall heat transfer coefficient for the plastic condenser was 105 BTU/hr./ft$^2$/° F. compared to 82 BTU/hr./ft.$^2$/° F. for Friedrich glass condenser, which is 105/82=1.3 times higher. Comparing the two cell condenser to the literature values of the industrial glass condenser HE 1.5, the results were as follows: steam condensed for plastic condenser was 7.4 l/hr./ft.$^2$ vs. 3.5 for glass condenser HE 1.5, or 7.4/3.5=2.1 times higher. Heat transfer coefficient was also higher for the plastic condenser: 105 compared to 54 for the glass condenser or 1.94 times greater.

EXAMPLE 3

This three cell condenser as illustrated in FIG. 3 was fabricated like the two cell type of example 2 but unlike the two cell type has two outer cooling cells on each side of the center vapor cell which is separated from the cooling cells by two heat transfer discs. A circumferential wall for the vapor cell was produced by machining a plastic ring of the same diameter as the shell sides. The two shell sides were 10 in: in diameter with a ⅛ in. wall and the ring was also 10 in. dia. by about 1 in. wide with a ⅛ in. thick wall. The two discs were secured to the shell sides and center ring, by two compression rings shrunk fit, as described in example 2. In this case the compression rings were stainless steel type 316, instead of aluminum, although they could have been of a variety of metals and alloys, and plastics described in example 2. The two shell walls were high density polyethylene and the center ring PFA. The graphite discs were laminated with PFA on their inner wall side (vapor cell condensing wall) to a 0.005 in. thickness, and with PCTFE of 2 mil thickness on the opposite side of the disc (water cooling cells). Inlet and outlet ports in the vapor and cooling cells were provided with fittings as in example 2. The preferred method of fabricating the shell is by injection molding of the two shell side walls, and vapor cell plastic ring, with ports also molded in the vapor and cooling cells.

The condensing capacity of this 3 cell type is higher than that of the Friedrich, and industrial type HE 1.5 glass condensers described in examples 1 and 2, at 8.0 liters/hr. for condensed steam compared to 7 l/hr. for the 24 in. long HE 1.5, and 1.66 l/hr. for the Friedrich condenser. The yield per hour per sq. ft. of area was also higher at 7.4 l/hr./ft$^2$ for the 3 cell type, 5.35 for the Friedrich glass, and 3.5 for the HE 1.5. The overall heat transfer coefficients were 105 BTU/hr./ft.$^2$/° F. for the three cell condenser, 82 for the Friedrich, and 54 for the HE 1.5 glass condenser.

EXAMPLE 4

This two cell laboratory condenser was constructed as illustrated in FIG. 4 and was fabricated in the same way as the flanged two cell condenser of example 1, with the difference that no holes were drilled in the flange. In the place of bolts through the flange walls, heat transfer disc, and reinforcing rings, two stainless steel clamping rings 74, 76 were used to grip the flanges 72, 73 around the heat transfer disc 67 securing and sealing the two shell sides 61, 62 to the disc 67. The clamping rings 74, 76 are firmly held together by stainless nuts and bolts 75 through the rings. In this example the vapor cell side of the shell is of PFA plastic, the water cell side is of transparent polysulfone. The heat transfer disc is of borosilicate glass of high chemical resistance, shock mounted and protected from impact by the plastic shell. If fracture of the glass disc did occur it would be fail-safe, and not catastrophic as could be the case with an impact sensitive glass condenser.

This two cell condenser was compared, as in the other examples, to two well known types of glass condensers: a small Friedrich type, and a small industrial type. In this case the yield for condensed steam was 1.1 l/hr., compared to 1.66 l/hr. for the Friedrich condenser, and 7 l/hr. for the 24 in. long Corning HE 1.5 industrial type condenser (literature values). The yield per hour per sq. ft. of area was 5.4 l/hr./ft$^2$, compared to 5.35 for the Friedrich condenser, and 3.5 for the HE 1.5. The overall heat transfer coefficients were 77 BTU/hr./ft.$^2$/° F. vs. 82 for the Friedrich condenser and 54 for the HE 1.5.

Thus it can be seen that the performance of this type of two cell condenser is at least the equivalent of two widely used types of glass condensers with the added advantages of safety and compactness. The use of a polysulfone side wall also allows visibility into the water cell and through the water cell to the vapor cell, as well as visibility through the translucent PFA vapor cell wall. To this is added versatility in the use of a variety of interchangeable heat transfer discs, and side walls, where higher condensing rates may be required, or a higher product purity for example. This condenser, along with all the others of this invention, allows for the easy insertion of a variety of ports, connections etc. into the plastic shell for experimental work and the like.

EXAMPLE 5

This two cell condenser was built similar to that shown in FIG. 4 and was fabricated like the flanged condenser described in example 4, with the exception that a permanent retaining or clamping ring was used to secure and seal the heat transfer disc to the two side wall halves of the shell (not shown). In this example the vapor cell side of the shell is of FEP fluoroplastic, and the cooling cell side of the shell is polypropylene, both materials being translucent. The side walls are convex, as in example 2, and the shell diameter is 10 in. The 10 in. disc is of carbon steel coated on all surfaces with a 0.015 in. layer of a highly chemically resistant borosilicate type glass. The steel substrate is 0.125 in. thick.

This condenser was compared, as in the other example, to the two types of widely used glass condensers. In this example the yield for condensed steam was 4.54 l/hr., compared to 1.66 l/hr. for the Friedrich condenser, and 7 l/hr. (literature values) for the 24 in. long HE 1.5 small industrial glass condenser. The yield per hour per sq. ft. of heat transfer area was 8.35 l/hr./ft$^2$, compared to 5.35 for the Friedrich, and 3.5 for the HE 1.5 glass condenser. The overall heat transfer coefficients were 119 BTU/hr./ft.$^2$/° F. for the example 2 cell condenser compared to 82 for the Friedrich, and 54 for the HE 1.5.

Thus, the good heat transfer performance of the example 10 in. diameter disc-shaped condenser can be seen. This condenser, like the others of this invention, can be readily connected in a series with a second and a third of the same type or of a different size and type, by connecting vapor cells to vapor cells and cooling cells to cooling cells, or connections can be made in parallel if desired. This again illustrates the versatility and usefulness of the disc-cell series of condensers.

EXAMPLE 6

This condenser was made with three cells as illustrated in FIG. 3 and was fabricated like the one in example 3, with the exception of the method of fastening (separable) and the type of heat transfer discs. These discs were also of 0.5 in. thick × 10 in. dia. graphite, as in example 3, but were laminated with 0.018 in. polysulfone film on their vapor cell sides, and with 0.002 in. thick CTFE fluoroplastic film on their water cooling cells sides. As previously mentioned the CTFE has excellent resistance to water absorption. The center ring was of ECTFE polymer, and the two side walls of polysulfone plastic. Two removable compression bands of stainless steel 316 were used to secure the two discs to the shell components, instead of the two permanently secured compression shrink rings of example 3.

This three cell condenser was compared to the two types of glass condensers used in all the examples as follows: condensed steam yield 5.0 l/hr. vs. 1.66 l/hr. for Friedrich glass condenser, and 7.0 l/hr. for the model HE 1.5 glass condenser (literature values for HE 1.50). The yield per hour per unit of area was 4.6 l/hr./ft.$^2$ for the 3 cell type, 5.35 for the Friedrich, and 3.5 for the HE 1.5. The overall heat transfer coefficients were 65 BTU/hr./ft$^2$/° F. for the 3 cell, 82 for the Friedrich, and 53 (lit. value) for the HE 1.5.

EXAMPLE 7

This 2 cell condenser of this example was made as illustrated in FIG. 2 and was fabricated like the example 2 condenser with the exception of the method of fastening (permanent) by means of plastic welding the two shell sides, securing the heat transfer disc to the shell. The materials used also differed. The two shell sides were of high density polyethylene, the heat transfer disc was cold rolled aluminum alloy 1100, 0.015 in. thick, laminated to 0.004 in. thick polyethylene on the vapor cell side, the water cooling side of the disc was not coated.

The 2 cell condenser of this example was compared to the two glass condensers used in all the examples as follows: condensed steam yield 2.35 l/hr. vs. 1.66 l/hr. for the Friedrich and 7.0 l/hr. for HE 1.5 The yield/hr./ft.$^2$ was 11.98 compared to 5.35 BTU/hr./ft.$^2$/° F., for the Friedrich type, and 3.5 for the HE 1.5.

EXAMPLE 8

The two cell condenser of this example is similar to that shown in FIG. 1 and was fabricated as the separable flanged type of example 1 with the following exceptions: the diameter of the shell was only about 4 in. and the heat transfer disc was stainless steel type 316 without a coating on either side. The disc was 0.0625 in thickness. The two plastic shell halves were of high density polyethylene.

The example 8 condenser was compared to the two glass types with the following results: steam condensate yield 1.12 l/hr. vs. 1.66 for the Friedrich and 7 for the HE 1.5 The yield/hr./ft.$^2$ was 12.9 for the 2 cell, vs. 5.35 for the Friedrich, and 3.5 for the HE 1.5 The overall coefficient was 184 BTU/hr./ft.$^2$/° F. for the 2 cell, 82 for the Friedrich and 54 for the HE 1.5. The small compact geometry of this should prove useful as a component of home and laboratory condensers where the highest purity is not required.

In all of the above examples the plastic coating on the vapor cell side of the heat transfer disc is a film selected from the fluoroplastics, polyolefins, or other chemically resistant anti-contaminating plastic materials. The plastic on the water cooling side of the disc is one selected from the fluoroplastics, polyolefins, polysulfones, epoxies, phenolics or other chemically resistant polymers with low water absorption. The shell walls may both be of a fluoroplastic, but generally only the vapor shell side is a fluoroplastic or a polymer of good chemical resistance and anti-contaminating nature, whereas the cooling shell wall may be selected from the polyolefins, polysulfones, polycarbonates, polyetherimides, polyimides, polyetheretherketones, polyphenylenesulfides, polyethersulfones, polyarylsulfones, phenolics, nylons. While certain representative embodiments and details have been shown for the purpose of illustrating the invention, it will be apparent to those skilled in the art that various changes and other modifications may be made therein without departing from the scope of the invention.

What is claimed is:

1. An impact resistant compact condenser comprising a plastic shell having two side walls enclosing at least one heat transfer disc having generally smooth side surfaces, said at least one heat transfer disc being disposed between said side walls dividing said shell into at least one cooling cell and at least one unobstructed vapor cell, means for retaining said disc in sealed abutment against said end walls of said side walls, each of said cells having an inlet port and an outlet port, said outlet port of said vapor cell being positioned so as to allow gravity flow of condensate therefrom.

2. A condenser according to claim 1 wherein said heat transfer disc is made from a corrosive resistant material.

3. A condenser according to claim 1 wherein said heat transfer disc has a coating of a chemically resistant material on its vapor cell side.

4. A condenser according to claim 3 wherein said heat transfer disc has a coating of a chemically resistant material on its cooling cell side.

5. A condenser according to claim 1 wherein said heat transfer disc is made of a graphite material with a chemically resistant, non-contaminating plastic coating on its vapor cell side and a chemically resistant plastic coating on its cooling cell side.

6. A condenser as defined in claim 1 when wherein said disc is made of a corrosive resistant metallic material that has a chemically resistant, non-contaminating plastic coating on its vapor cell side, and a chemically resistant plastic coating on its cooling side.

7. A condenser according to claim 1 wherein said disc is made of a metallic material having a corrosion resisting glass or glass-ceramic coating on all of its surfaces.

8. A condenser according to claim 1 wherein said disc is made of a corrosion resistant glass or glass ceramic material.

9. A condenser according to claim 1 wherein said disc is made of a corrosion resistant matallic material.

10. A condenser according to claim 1 wherein said plastic shell is readily separable for insertion or removal of said different heat transfer disc.

11. A condenser according to claim 3 wherein said coating has a sufficient thickness so as to provide minimal resistance to heat transfer but of sufficient thickness to resist vapor or liquid penetration into said disc.

12. A condenser according to claim 5 wherein each of said coatings have a sufficient thickness so as to provide minimal resistance to heat transfer but of sufficient thickness to resist vapor or liquid penetration into said disc.

13. A condenser according to claim 6 wherein each of said coatings have a sufficient thickness so as to provide minimal resistance to heat transfer but of sufficient thickness to resist vapor or liquid penetration into said disc.

14. A condenser according to claim 7 wherein said coating has a sufficient thickness so as to provide minimal resistance to heat transfer but of sufficient thickness to resist vapor or liquid penetration into said disc.

15. A condenser according to claim 1 wherein said means for retaining said heat transfer disc in sealed abutment against said side walls is a corrosion resistant compression ring heat shrunk fit around the outer circumferential surface of said side walls.

16. A condenser according to claim 1 wherein said means for retaining said heat transfer disc in sealed abutment comprises flanges formed on each of said side walls which are secured together by a clamping ring permanently secured around said flange.

17. A condenser as defined in claim 3 wherein said coating on the vapor cell side of the heat transfer disc is a film selected from the fluoroplastics, polyolefins, or other chemically resistant anti-contaminating plastic materials.

18. A condenser according to claim 4 wherein said coating on cooling cell side of said heat transfer disc is a film selected from the fluoroplastics, polyolefins, polysuffones, epoxies, phenolies, or other chemically resistant polymers of the same kind as vapor cell or different.

19. A condenser as defined in claim 6 wherein said corrosion resistant matallic material disc is an aluminum metal or alloy, a stainless steel, or other stainless corrosion resistant metals and alloys.

20. A condenser as defined in claim 8 wherein said glass or glass-ceramic disc is of a borosilicate glass.

21. A condenser as defined in claim 1 wherein said plastic shell walls are of a fluoroplastic, or only the shell wall on the vapor cell side, is a fluoroplastic or other chemically resistant, anti-contaminating plastic material, and the shell wall on the water cooling cell side is of the same plastic or a different kind selected from the group polyolefins, polysulfones, polycarbonates, polyetherimides, polyimides, polyetheretherketones, polyphenylene sulfides, polyether sulfones, polyarylsulfones, phenolics, or nylons.

22. A condenser as defined in claim 15 wherein said compression ring is one that is readily removed or applied permitting said plastic shell to be disassembled for the insertion of a different heat transfer disc or a different sidewall.

23. A condenser as defined in claim 1 wherein said plastic side walls each have a flange for securing said heat transfer disc in sealed abutment to said side walls.

24. A condenser according to claim 23 further comprising nuts and bolts, permitting said plastic shell to be disassembled for the insertion of a different heat transfer disc or different sidewalls.

25. A condenser as defined in claim 15 where two heat transfer discs are secured to said plastic shell by means of two permanently assembled compression shrink rings.

26. A condenser as defined in claim 25 wherein said shell further comprising a circumferential ring between said side walls, two heat transfer discs are provided in spaced apart relationship to form two cooling cells and one vapor cell and are secured to said plastic shell by means of two permanently assembled clamping rings.

27. A condenser as defined in claim 22 wherein two heat transfer discs are secured to said plastic shell by means of two compression rings that are readily removed or applied.

28. A condenser as defined in claim 23 where two heat transfer discs are used with flanged shell and secured by means of nuts and bolts permitting the condenser shell to be separable.

29. A condenser as defined in claim 15 wherein means for sealing and securing said heat transfer disc to said plastic shell is by joining said side walls of said shell by plastic welding.

30. A condenser as defined in claim 1 wherein said plastic shell is divided by two heat transfer discs into a center vapor cell with a cooling cell on each side.

31. A condenser as defined in claim 23 wherein said flanges are sealed and secured to said heat transfer disc by two clamping rings fastened by nuts and bolts above periphery of said heat transfer disc.

32. A condenser as defined in claim 1 wherein said condenser is joined in series with a second or third condenser by 33. A condenser according to claim 1 wherein sides of said heat transfer disc are substantially parallel to said side walls of said shell.

34. An impact resistant compact condenser comprising a plastic shell having two side walls enclosing at least one heat transfer disc, said at least one heat transfer disc having substantially flat sides being disposed between said side walls dividing said shell into at least one unobstructed cooling cell and at least one unobstructed vapor cell, means for retaining said disc in sealed abutment against said end walls of said side walls, each of said cells having an inlet port and an outlet port, said outlet port of said vapor cell being positioned so as to allow gravity flow of condensate therefrom.

35. An impact resistant compact condenser comprising a plastic shell having two side walls enclosing at least one heat transfer disc, said at least one heat transfer disc having substantially flat and parallel sides being disposed between said side walls dividing said shell into at least one unobstructed cooling cell and at least one unobstructed vapor cell, means for retaining said disc in sealed abutment against said end walls of said side walls, each of said cells having an inlet port and an outlet port, said outlet port of said vapor cell being disposed so as to allow gravity flow of condensate therefrom, said heat transfer disc is made from a corrosive resistant material.

36. An impact resistant compact condenser comprising a plastic shell having two side walls enclosing at least one heat transfer disc, said at least one heat transfer disc having substantially flat side walls which aligned substantially parallel to said side walls of said shell being disposed between said side walls dividing said shell into at least one unobstructed cooling cell and at least one unobstructed vapor cell, means for retaining said disc in sealed abutment against said end walls of said side walls, each of said cells having an inlet port and an outlet port, said outlet port of said vapor cell being positioned so as to allow gravity flow of condensate therefrom, the side wall of said heat transfer disc facing said vapor cell has a coating of a corrosive resistant material.

* * * * *